US009607542B2

(12) United States Patent
Duan et al.

(10) Patent No.: US 9,607,542 B2
(45) Date of Patent: Mar. 28, 2017

(54) DISPLAY PANEL DRIVING METHOD, DRIVING DEVICE AND DISPLAY DEVICE

(71) Applicants: BEIJING BOE MULTIMEDIA TECHNOLOGY CO., LTD., Beijing (CN); BOE TECHNOLOGY GROUP CO., LTD., Beijing (CN)

(72) Inventors: Xin Duan, Beijing (CN); Xuezheng Li, Beijing (CN)

(73) Assignees: BEIJING BOE MULTIMEDIA TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 150 days.

(21) Appl. No.: 14/236,204

(22) PCT Filed: Oct. 8, 2013

(86) PCT No.: PCT/CN2013/084850

§ 371 (c)(1),
(2) Date: Jan. 30, 2014

(87) PCT Pub. No.: WO2014/169591

PCT Pub. Date: Oct. 23, 2014

(65) Prior Publication Data

US 2015/0294614 A1 Oct. 15, 2015

(30) Foreign Application Priority Data

Apr. 18, 2013 (CN) ..... 2013 1 0136371

(51) Int. Cl.

| | |
|---|---|
| ***G09G 5/00*** | (2006.01) |
| ***G09G 3/20*** | (2006.01) |
| ***G09G 3/36*** | (2006.01) |

(52) U.S. Cl.

CPC ..... *G09G 3/2092* (2013.01); *G09G 3/3666* (2013.01); *G09G 3/3677* (2013.01);
(Continued)

(58) Field of Classification Search

CPC .. G09G 3/3674; G09G 3/2092; G09G 3/3677; G09G 2310/08

See application file for complete search history.

(56) References Cited

U.S. PATENT DOCUMENTS

2006/0208993 A1 9/2006 Jung
2012/0075334 A1* 3/2012 Pourbigharaz ..... G06F 3/1438 345/619

FOREIGN PATENT DOCUMENTS

CN 1786777 A 6/2006
CN 101383913 A 3/2009
(Continued)

OTHER PUBLICATIONS

International Search Report for International Application No. PCT/CN2013/084850, 10pgs.
English abstract of CN102592531A, listed above, 1 page.
English abstract of CN1786777A, listed above, 1 page.
English abstract of CN101383913A, listed above, 1 page.
First Office Action (Chinese language) issued by the State Intellectual Property Office ("SIPO") on Oct. 10, 2014 for International Application No. 201310136371.8, 10 pages.
(Continued)

*Primary Examiner* — Dennis Joseph
(74) *Attorney, Agent, or Firm* — Ladas & Parry LLP

(57) ABSTRACT

The embodiments of the present invention provide a display panel driving method, a driving device and a display device, which can improve the time delay of the gate driving signals of a partitioned controlled display panel and reduce the production cost. The display panel comprises at least two time sequence controllers and at least two display areas, each of the time controllers corresponding to one of the display areas respectively; the driving method comprises each of the time sequence controllers obtaining a synchronization signal according to an obtained display signal of the corresponding display area, the synchronization signal comprising a starting time of a first line of scanning signals of the corresponding display area, the time sequence controllers
(Continued)

adjusting the starting times of the first lines of the scanning signals according to the synchronization signals of at least one display area so as to make the starting times of the first lines of the scanning signals of all display areas are the same.

11 Claims, 5 Drawing Sheets

(52) U.S. Cl.
CPC ..... *G09G 2300/043* (2013.01); *G09G 2300/0408* (2013.01); *G09G 2310/08* (2013.01); *G09G 2320/00* (2013.01); *G09G 2320/0223* (2013.01)

(56) References Cited

FOREIGN PATENT DOCUMENTS

| | | | |
|---|---|---|---|
| CN | 102592531 | A | 7/2012 |
| CN | 103236241 | A | 8/2013 |

OTHER PUBLICATIONS

English translation of first Office Action (listed above) issued by ("SIPO") on Oct. 10, 2014 for International Application No. 201310136371.8, 9 pages.
International Preliminary Report on Patentability Appln. No. PCT/CN2013/084850; Dated Oct. 20, 2015.

* cited by examiner

DISPLAY PANEL DRIVING METHOD, DRIVING DEVICE AND DISPLAY DEVICE

CROSS REFERENCE TO RELATED APPLICATIONS

This application is based on International Application No. PCT/CN2013/084850 filed on Oct. 8, 2013, which claims priority to Chinese National Application No. 201310136371.8 filed on Apr. 18, 2013, the contents of which are incorporated herein by reference.

TECHNICAL FIELD

The embodiment of the present invention relates to a display panel driving method, a driving device and a display device.

BACKGROUND

In the traditional display device, the scanning drive of the display module part usually controls the gate driving circuit through a piece of signal processing chip, thereby transmitting the gate driving signal to the display panel according to a preset time sequence, and therefore no synchronization problem exists therein. However, in the display product with large size or high resolution, a single chip is usually unable to finish the scanning drive for the whole display panel because it needs to process large amount of signals at the same time, and thus a plurality of chips are usually used to perform the scanning drive for different display areas at the same time. Therefore, the coordination among the plurality of chips is especially important.

In the conventional chip design, in order to realize the coordination among a plurality of chips, a frame memory unit is usually added to each chip, and frame memory units of each two chips communicate through signals of a serial peripheral interface bus (referred to as SPI) at the same time, so that each two chips work synchronously. The synchronized process specifically is as follows: a picture with more than one frame is pre-stored in the two chips, and the two chips each send data to the respective controlled display area through the SPI signal at the same time. However, the disadvantages are that there still remains delay in the gate drive signals among the plurality of chips as well as different transmission paths of each chip, and it will further increase the production cost since a memory is added to each chip.

SUMMARY

The embodiment of the present invention provides a display panel driving method, a driving device and a display device, which can improve the time delay existing in the gate driving signal of the partitioned controlled display panel, and reduce the production cost.

In order to achieve the above object, the embodiment of the present invention may adopt the following technical solution.

In an aspect of the embodiment of the present invention, it provides a display panel driving method, wherein the display panel comprises at least two time sequence controllers and at least two display areas, each of the time sequence controllers corresponding to one of the display areas, respectively; the driving method comprises each of time sequence controllers obtaining a synchronization signal according to an obtained display signal of the corresponding display area, the synchronization signal comprising a starting time of a first line of scanning signals of the corresponding display area, the time sequence controllers adjusting the starting times of the first lines of the scanning signals of all the display areas according to the synchronization signal of at least one display area so that the starting times of the first lines of the scanning signals of all the display areas are the same.

In another aspect of the embodiment of the present invention, it provides a display panel driving device comprising at least two time sequence controllers, each of the time sequence controllers corresponding to one of the display areas; wherein each of the time sequence controllers obtains a synchronization signal according to an obtained display signal of the corresponding display area, the synchronization signal comprises a starting time of a first line of scanning signals of the corresponding display area, the time sequence controllers adjust the starting times of the first lines of the scanning signals of all the display areas according to the synchronization signal of at least one display area so as to make the starting times of the first lines of the scanning signals of all the display areas to be the same. In still another aspect of the embodiment of the present invention, it provides a display device comprising the above described display panel driving device.

BRIEF DESCRIPTION OF THE DRAWINGS

In order to illustrate the technical solution of the embodiments of the present invention more clearly, the drawings of the embodiments will be briefly described below; it is obvious that the drawings as described below are only related to some embodiments of the present invention, and thus are not limitative of the present invention.

DETAILED DESCRIPTION

Figure 1:
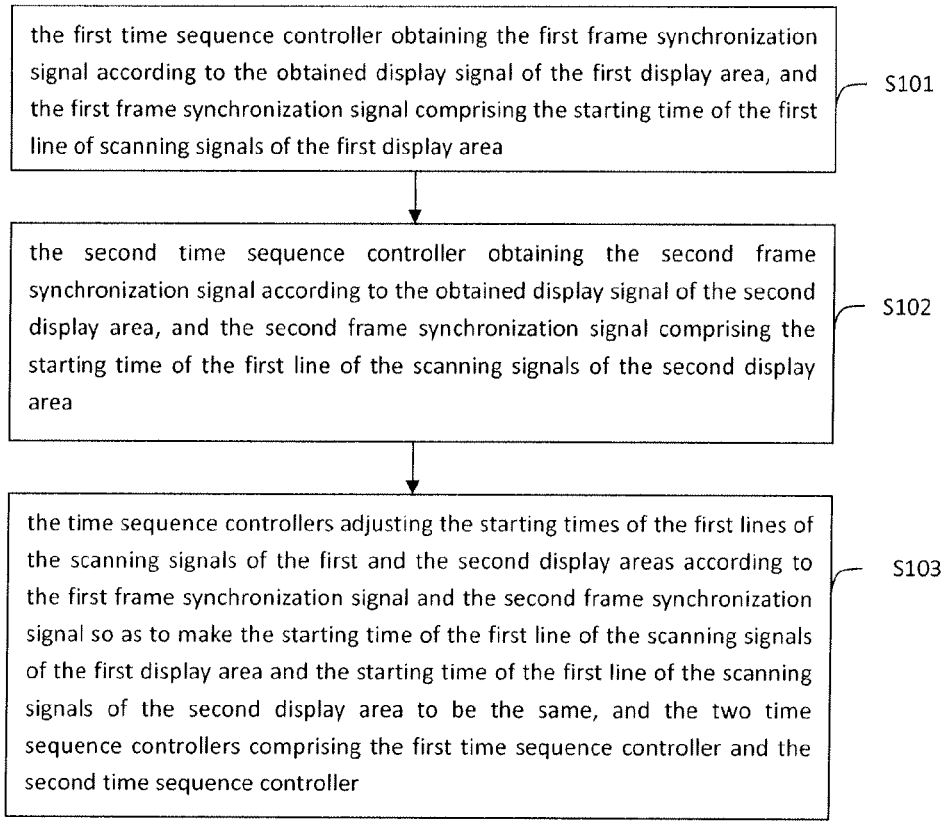
FIG. 1 is a schematic flow diagram of the display panel driving method provided in an embodiment of the present invention.

The technical solutions of the embodiments of the present invention will be described in a clearly and fully understandable way in connection with the drawings related to the embodiments of the present invention. It is obvious that the described embodiments are just a portion but not all of the embodiments of the present invention. According to the embodiments of the present invention, all other embodiments obtained by those ordinary skilled in the art under the premise of without creative efforts are all intend to be within the scope of the present invention.

Unless otherwise defined, the technical or scientific terms used herein shall have the general meanings understandable for those ordinarily skilled in the field of the present invention. "First", "second" and the like used in specification and claims of the patent application of the present invention do not show any order, number or importance, but are only used to distinguish different constituent portions. Likewise, the words such as "a", "an", "the" or similar shall not represent limitation of numbers, but mean existence of at least one. The phrases such as "include", "comprise" or similar intend to mean the elements or objects before such words cover or are equivalent to the elements or objects listed after such words, but other elements or objects are not exclusive. The phrases such as "connect", "connected" or similar are not limited to physical or chemical connection, but also include electrical connection, no matter directly or indirectly. The phrases such as "upper", "lower", "left", "right" and etc. shall be used only to represent relative positions, wherein when the absolute position of the described object is changed, the relative positions may be changed accordingly.

The display panel provided in the embodiment of the present invention comprises at least two time sequence controllers and at least two display areas, each of the time sequence controllers corresponding to one of the display areas; the driving method comprises each of the time sequence controllers obtaining a synchronization signal according to an obtained display signal of the corresponding display area, the synchronization signal comprising a starting time of a first line of scanning signals of the corresponding display area, the time sequence controllers adjusting the starting times of the first lines of the scanning signals of all display areas according to the synchronization signal of at least one display area so as to make the starting times of the first lines of the scanning signals of all display areas to be the same.

The display panel driving method provided in the embodiment of the present invention realizes the synchronization adjustment of the time sequence signals in the partitioned controlled display panel by using the time sequence controllers to differentially calculate the synchronization signals at different locations and adjusting the starting location of the display image, whereby it effectively improves the delay of the gate driving signals. In addition, it is unnecessary to set a mass of display buffer units for the display panel with this structure, thereby dramatically reducing the production cost of the display product.

Further, taking the display panel comprising two time sequence controllers, i.e., the first time sequence controller and the second time sequence controller, as an example, the first time sequence controller corresponds to the first display area, and the second time sequence controller corresponds to the second display area. The display panel driving method provided in the embodiment of the present invention, as shown in FIG. 1, comprises the steps hereinafter.

In S101, the first time sequence controller obtains the first frame synchronization signal according to the obtained display signal of the first display area, and the first frame synchronization signal comprises the starting time of the first line of scanning signals of the first display area.

In S102, the second time sequence controller obtains the second frame synchronization signal according to the obtained display signal of the second display area, and the second frame synchronization signal comprises the starting time of the first line of the scanning signals of the second display area.

Specifically, for example, each of the time sequence controllers may obtain the proximal display signal of the corresponding display area, and obtain the starting time of the first line of the scanning signals of the display area according to the time signal recorded in the display signal, and thereby forms a frame synchronization signal.

In S103, the time sequence controllers adjust the starting times of the first lines of the scanning signals of the first and the second display areas according to the first frame synchronization signal and the second frame synchronization signal so as to make the starting time of the first line of the scanning signals of the first display area and the starting time of the first line of the scanning signals of the second display area to be the same, and the two time sequence controllers comprise the first time sequence controller and the second time sequence controller.

It is noted that, in the partitioned controlled display panel provided in the embodiment of the present invention, the display panel comprises a plurality of display areas, and the display panel comprises at least two time sequence controllers, each of the time sequence controllers corresponding to one of the display areas for controlling the output of the time sequence of the gate driving signal in the corresponding display area. It should be appreciated that the aforesaid first and second time sequence controllers are only used to distinguish any two different time sequence controllers instead of defining the number of the time sequence controllers of the present invention. When there are a plurality of time sequence controllers, any two time sequence controllers of them may satisfy the steps of above method.

Figure 2:
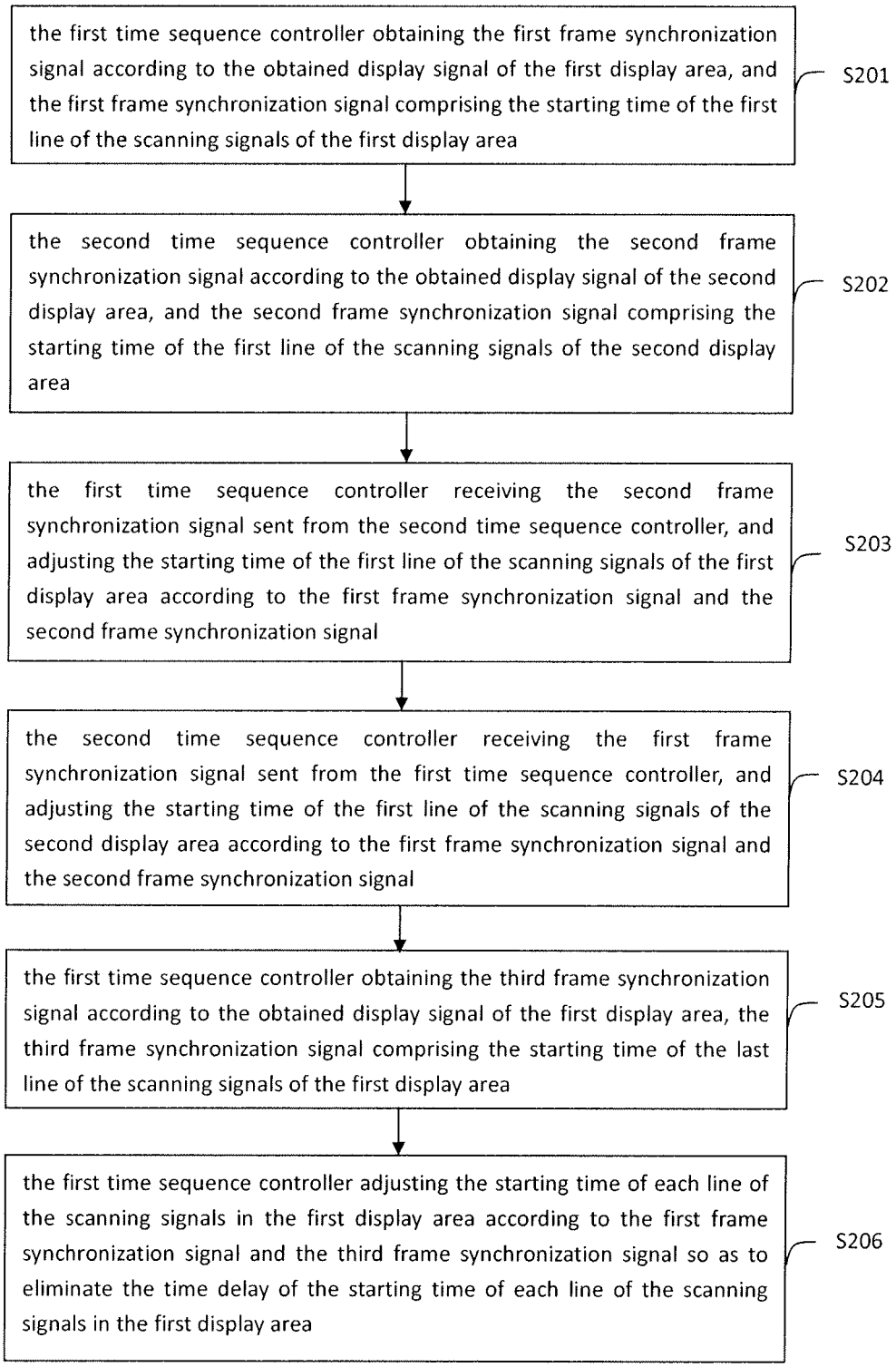
FIG. 2 is a schematic flow diagram of another display panel driving method provided in an embodiment of the present invention.

Further, as shown in FIG. 2, taking the display panel comprising two time sequence controllers, i.e., the first time sequence controller and the second time sequence controller, as an example, the first time sequence controller corresponds to the first display area, and the second time sequence controller corresponds to the second display area. For example, the display panel driving method provided in the embodiment of the present invention may comprise the steps hereinafter.

In S201, the first time sequence controller obtains the first frame synchronization signal according to the obtained display signal of the first display area, and the first frame synchronization signal comprises the starting time of the first line of the scanning signals of the first display area.

In S202, the second time sequence controller obtains the second frame synchronization signal according to the obtained display signal of the second display area, and the second frame synchronization signal comprises the starting time of the first line of the scanning signals of the second display area.

In S203, the first time sequence controller receives the second frame synchronization signal sent from the second time sequence controller, and adjusts the starting time of the first line of the scanning signals of the first display area according to the first frame synchronization signal and the second frame synchronization signal.

In S204, the second time sequence controller receives the first frame synchronization signal sent from the first time sequence controller, and adjusts the starting time of the first line of the scanning signals of the second display area according to the first frame synchronization signal and the second frame synchronization signal.

For example, after the first time sequence controller and the second time sequence controller each generate their respective frame synchronization signals according to the display signals of the corresponding display areas, they may each send the respective frame synchronization signals to other time sequence controller(s). (That is to say, the first time sequence controller sends the frame synchronization signal to the time sequence controller(s) other than the first time sequence controller, and the second time sequence controller sends the frame synchronization signal to the time sequence controller other than the second time sequence controller.) Then, the time sequence controllers each adjust the starting time of the first line of the scanning signals.

For example, when there are only the first time sequence controller and the second time sequence controller, adjusting the starting times of the first lines of the scanning signals according to the first frame synchronization signal and the second frame synchronization signal may comprises:

obtaining the first time delay t1 between the starting time of the first line of the scanning signals of the first display area and the starting time of the first line of the scanning signals of the second display area according to the first frame synchronization signal and the second frame synchronization signal;

adjusting the starting time of the first line of the scanning signals of the first display area and the starting time of the first line of the scanning signals of the second display area forward or backward by a half of the first time delay t½, respectively, so as to make the starting time of the first line of the scanning signals of the first display area and the starting time of the first line of the scanning signals of the second display area to be the same.

Thus, when there is a delay between the proximal display signals of the first display area and the second display area, for example, the display delay between the two areas is t1, the synchronization in both display areas may be realized by delaying the signal time sequence that is relatively early by a half of the time delay, i.e., t½, and bringing forward the signal time sequence that is relatively late by a half of the time delay, i.e., t½. This display panel driving method may simply realize the synchronization of the partitioned control.

Alternatively, when there are two or more time sequence controllers, the starting time of the first line of the scanning signals of the display area corresponding to one of the time sequence controllers may be taken as a standard time, and other time sequence controllers each adjust the starting time of the first line of the scanning signals of the corresponding display area forward or backward according to the standard time so as to eliminate the time delay of the starting times of the first lines of the scanning signals in different display areas, and thus the synchronization of the partitioned control is achieved.

It is noted that, in the embodiment of the present invention, a few lines of registers may be provided in the time sequence controllers, which realize bringing forward or delaying the time sequence of the scanning signal by inserting or removing invalid data time (V-blanking time) in the vertical direction during the display signal processing. Bringing forward or delaying several lines of signals would not affect the display because several lines of the registers are added in the time sequence controllers.

In addition, the driving method of the display panel may further comprise:

each one of the time sequence controllers obtaining the synchronization signal according to the obtained display signal of the corresponding display area, and the synchronization signal further comprising the starting time of the last line of the scanning signals of the corresponding display area;

the time sequence controllers each adjusting the starting time of each line of the scanning signals in the corresponding display area according to the starting time of the first line of the scanning signals and the starting time of the last line of the scanning signals so as to eliminate the delay of the starting time of each line of the scanning signals in the corresponding display area.

For example, as shown in FIG. 2, taking the display panel comprising two time sequence controllers, i.e., the first time sequence controller and the second time sequence controller, as an example, the first time sequence controller corresponds to the first display area, and the second time sequence controller corresponds to the second display area. The display panel driving method provided in the embodiment of the present invention may further comprise:

in S205, the first time sequence controller obtaining the third frame synchronization signal according to the obtained display signal of the first display area, the third frame synchronization signal comprising the starting time of the last line of the scanning signals of the first display area, and in S206, the first time sequence controller adjusting the starting time of each line of the scanning signals in the first display area according to the first frame synchronization signal and the third frame synchronization signal so as to eliminate the time delay of the starting time of each line of the scanning signals in the first display area.

Due to the manufacturing process or external environment, there usually exists the time delay in the lines of the scanning signals in the distal end compared to the lines of the scanning signals in the proximal end of the display area, and the time delay existing in the transmission path may be eliminated by collecting the frame synchronization signal in the distal end.

For example, the specific process of the first time sequence controller adjusting the starting time of each line of the scanning signals of the first display area according to the first frame synchronization signal and the third frame synchronization signal may comprise:

the first time sequence controller obtaining the second time delay between the starting time of the last line of the scanning signals and the starting time of the first line of the scanning signals of the first display area according to the first frame synchronization signal and the third frame synchronization signal, and adjusting the starting time of each line of the scanning signal of the first display area forward according to the second time delay so as to eliminate the time delay of the starting time of each line of the scanning signals of the first display area.

For example, the first time sequence controller obtains the second time delay t2 between the starting time of the last line of the scanning signals and the starting time of the first line of the scanning signals of the first display area according to the first frame synchronization signal and the third frame synchronization signal. Usually, the gate scanning lines are provided in the vertical direction with equal intervals. The time delay t2/(n−1) occurring in each line of the signals compared to the previous one of the signals during transmission may be obtained according to the vertical resolution n of the display signals, and then the starting locations of the gate driving signals on different lines may be adjusted in the time sequence controller, i.e. bringing forward the starting time of the $m^{th}$ line of the gate driving signal by (m−1)*t2/(n−1). Thus, the effect of the time delay in the display area caused by the signal transmission path may be eliminated.

It is noted that, in the aforesaid embodiment, the process of the first time sequence controller adjusting the time sequence of the gate driving signal for the time delay occurring in the signal transmission path in the corresponding display area may also apply to other time sequence controllers. That is to say, other time sequence controller, such as the second time sequence controller, may also perform the steps S205 and S206 to eliminate the time delay of the starting time of each line of the scanning signals in the second display area. The embodiment herein is only illustrative, and thus is not limitative of the present invention.

Figure 3:
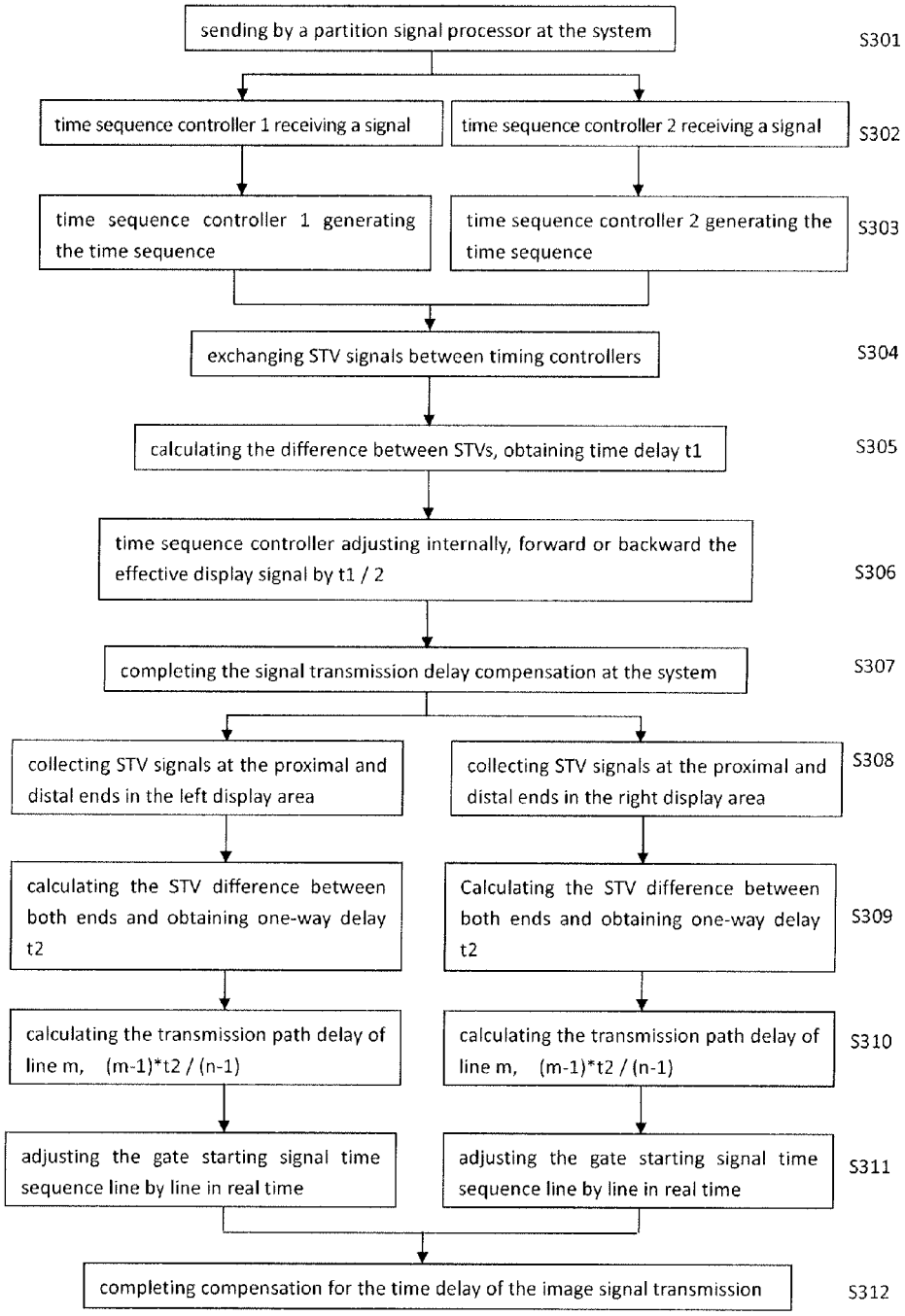
FIG. 3 is a schematic flow diagram of still another display panel driving method provided in an embodiment of the present invention.

With reference to the signal processing diagram as shown in FIG. 3, the display panel driving method provided in the embodiment of the present invention will be described specifically by taking the display panel dividing into left and right display areas and those two display areas each corresponding to the respective time sequence controllers as an example.

Figure 4:
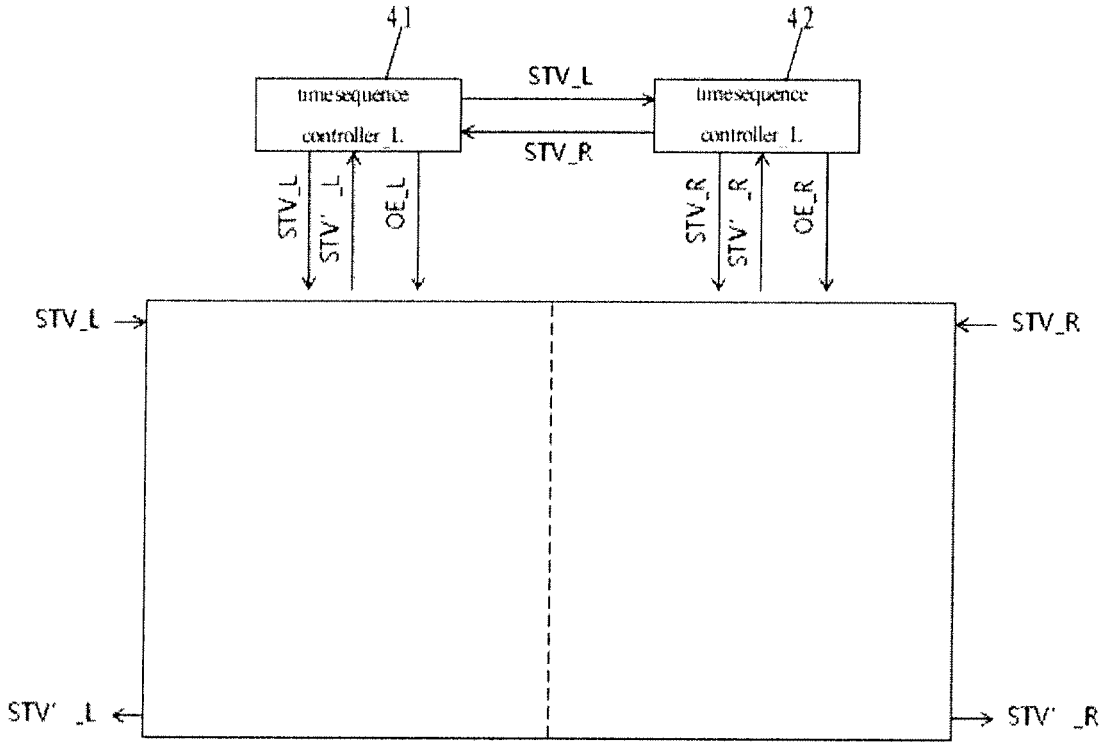
FIG. 4 is a schematic diagram for using the display panel driving device provided in an embodiment of the present invention.

In the display panel as shown in FIG. 4, the left and the right time sequence controllers L, R respectively obtain the proximal display signals (S302), and form the corresponding frame synchronization signals STV_L and STV_R (the suffixes L and R represent the left and the right time sequence controllers, respectively) (S303). Those frame synchronization signals are outputted to the proximal end of the display panel to control the initiation of the gate driver. Meanwhile, the left and the right time sequence controllers L, R output the gate driving signals OE_L and OE_R, respectively. It is possible for the frame synchronization signals STV_L and STV_R to form different signal delays after passing through the left and the right transmission paths due to the process, the delayed signal STV'_L and STV'_R may be collected in the distal end (adding "'" to distinguish the distal control signal from the proximal control signal).

Figure 5:
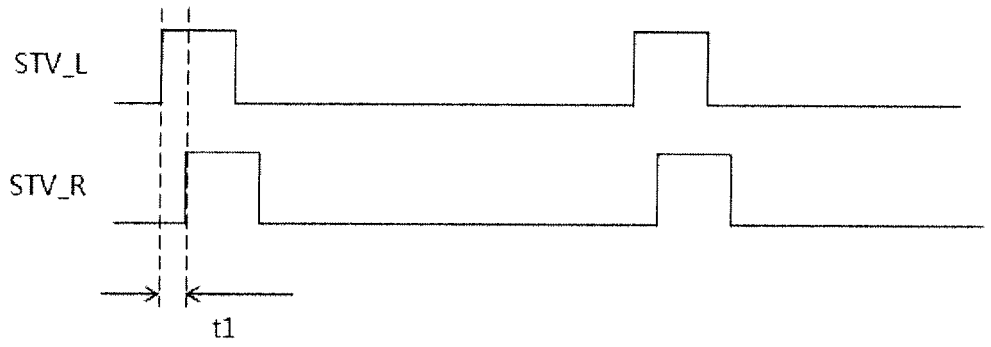
FIG. 5 is a time sequence structure diagram of the delay during the proximal signal processing in an embodiment of the present invention.

The two time sequence controllers each transmit the respective frame synchronization signals STV to the other one for comparison (S304). One of the time sequence controllers firstly compares the signal STV_L with the STV_R when receiving the STV signal from the other controller, and then obtains the time delay t1 between those two signals (S305). As shown in FIG. 5, the left and the right display areas are adjusted respectively, wherein, the image on the left side is delayed by a time of t½, and the image on the right side is brought forward by t½ (S306) since the time sequence of STV_L is relatively early. Thus, the synchronization of the partitioned control can be achieved. The method may be realized via inserting/removing the V-blanking time at the vertical direction during the display signal processing. Bringing forward or delaying several lines of signals would not affect the display since several lines of the registers are added into the time sequence controllers. Thus, it eliminates the problem of the time delay caused by the proximal signal processing.

Figure 6:
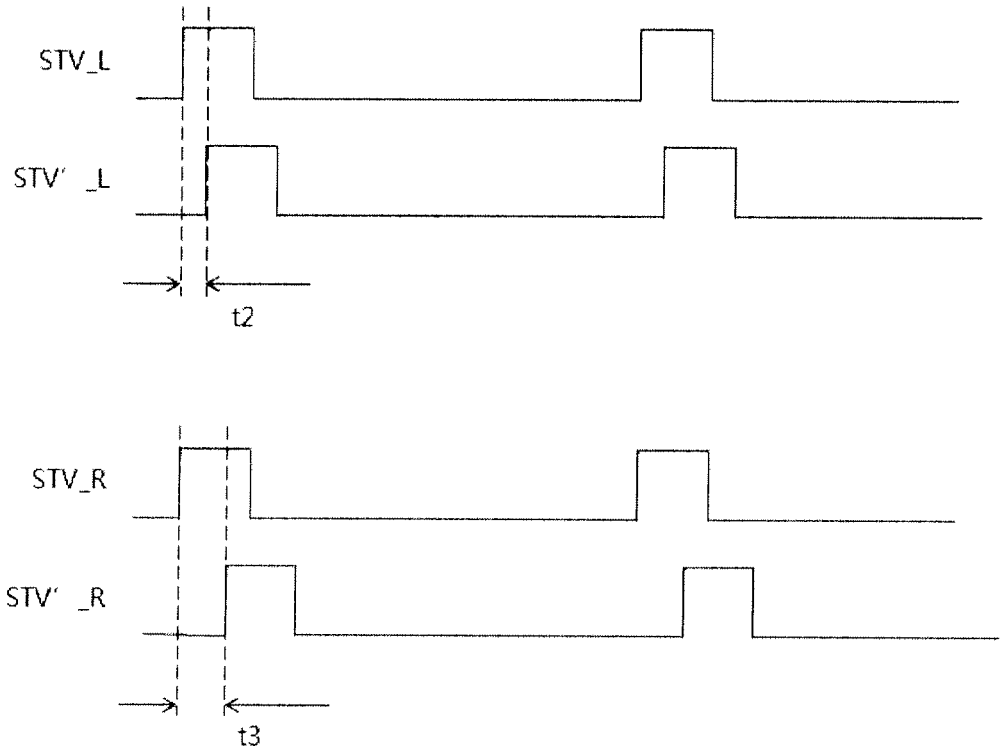
FIG. 6 is a time sequence structure diagram of the delay due to different transmission paths in the embodiment of the present invention.

During eliminating the time delay caused by the signal transmission path in the display area with the time delay problem, it needs to collect the distal STV signal (S308). The distal STV signal would be led to an external circuit because the display image needs to be flipped in the traditional display panel, and thus it can be obtained by using the related method in prior art. The present invention has no limitation on it. The time sequence controllers of the left and the right areas each compare the STV with the STV' signal of the corresponding area, and obtain different time delay t2 or t3 caused by the signal transmission path in the vertical direction of the corresponding area (S309), as shown in FIG. 6. Taking the display area on the left side as an example, the time sequence controller may obtain the time delay t2/(n−1) occurring in each line of the signals compared to the previous one of the signals during the transmission according to the vertical resolution (n) of the display signal, and then it may adjust the starting locations of the gate driving signals on the different lines, i.e. adjusting the starting location of the gate driving signal at the $m^{th}$ line forward by (m−1)*t2/(n−1) (S310-S311). Then, the effect of the different time delays in the left and the right display areas caused by the respective signal transmission paths may be eliminated, and thereby the consistent display effect between those two display areas as well as in any display areas would be achieved.

The display panel driving method provided in the embodiment of the present invention realizes the synchronization adjustment of the time sequence signals by the time sequence controllers in the partitioned controlled display panel differentially calculating the synchronization signals at different locations and adjusting the starting location of the display image therein, and whereby improves effectively the delay of the gate driving signal. In addition, it is unnecessary to provide a mass of display buffer units for the display panel for this structure, which dramatically reduces the production cost of the display product.

The display panel driving device provided in the embodiment of the present invention comprises at least two time sequence controllers, each of the time controllers corresponds to one display area; wherein, each of the time sequence controllers obtaining a synchronization signal according to the obtained display signal of the corresponding display area, the synchronization signal comprising a starting time of a first line of scanning signals of the corresponding display area, the time sequence controllers each adjusting the starting time of the first line of the scanning signals according to the synchronization signals of the display areas of at least two time sequence controllers so as to make the starting times of the first lines of the scanning signals of different display areas to be the same.

The display panel driving device provided in the embodiment of the present invention, as shown in FIG. 4, for example, comprises at least two time sequence controllers, each corresponding to one of the display areas. Taking the display panel comprising two time sequence controllers, i.e., the first time sequence controller and the second time sequence controller as an example, the first time sequence controller corresponds to the first display area, and the second time sequence controller corresponds to the second display area.

The first time sequence controller 41 is used to obtain the first frame synchronization signal according to the obtained display signal of the first display area, wherein the first frame synchronization signal comprises the starting time of the first line of the scanning signals of the first display area.

The second time sequence controller 42 is used to obtain the second frame synchronization signal according to the obtained display signal of the second display area, wherein the second frame synchronization signal comprises the starting time of the first line of the scanning signals of the second display area.

The time sequence controllers are further used to adjust the starting times of the first lines of the scanning signals according to the first frame synchronization signal and the second frame synchronization signal so as to make the starting time of the first line of the scanning signals of the first display area and the starting time of the first line of the scanning signals of the second display area to be the same.

The display panel driving device provided in the embodiment of the present invention realizes the synchronization adjustment of the time sequence signals by the time sequence controllers in the partitioning controlled display panel differentially calculating the synchronization signals at different locations and adjusting the starting location of the display image therein, and whereby improves effectively the delay of the gate driving signal. In addition, it is unnecessary to provide a mass of display buffer units for the display panel for this structure, which dramatically reduces the production cost of the display product.

It is noted that, in the partitioned controlled display panel provided in the embodiment of the present invention, the display panel comprises a plurality of display areas, and there are at least two time sequence controllers, the time sequence controllers each corresponding to one of the display areas for controlling the output of the time sequence of the gate driving signal in the corresponding display area. It should be appreciated that the aforesaid first and second time sequence controllers are only used to distinguish any two different time sequence controllers instead of defining the number of the time sequence controllers of the present invention. When there are a plurality of time sequence controllers, any two time sequence controllers of them may satisfy the steps of above method.

Further, taking the display panel comprising two time sequence controllers, i.e., the first time sequence controller and the second time sequence controller, as an example, the first time sequence controller corresponds to the first display area, and the second time sequence controller corresponds to the second display area. The first time sequence controller may be further used for:

obtaining the third frame synchronization signal according to the obtained display signal of the first display area, the third frame synchronization signal comprising the starting time of the last line of the scanning signals of the first display area, and adjusting the starting time of each line of the scanning signals of the first display area according to the first frame synchronization signal and the third frame synchronization signal so as to eliminate the time delay of the starting time of each line of the scanning signals of the first display area.

Due to the manufacturing process or external environment, there usually exists the time delay in the lines of the scanning signals in the distal end compared to the lines of the scanning signals in the proximal end of the display area, and the time delay existing in the transmission path may be eliminated by collecting the frame synchronization signals in the distal end.

For example, the specific process of the first time sequence controller adjusting the starting time of each line of scanning signals in the first display area according to the first frame synchronization signal and the third frame synchronization signal may comprises:

the first time sequence controller obtaining the second time delay between the starting time of the last line of the scanning signals and the starting time of the first line of the scanning signals of the first display area according to the first frame synchronization signal and the third frame synchronization signal, adjusting the starting time of each line of the scanning signals of the first display area according to the second time delay so as to eliminate the time delay of the starting time of each line of the scanning signals of the first display area.

For example, the first time sequence controller obtains the second time delay t2 between the starting time of the last line of the scanning signals and the starting time of the first line of the scanning signals of the first display area according to the first frame synchronization signal and the third frame synchronization signal. Usually, the gate scanning line is set in the vertical direction with equal intervals. The time delay t2/(n−1) occurring in each line of the signals compared to the previous one of the signals during the transmission may be obtained according to the vertical resolution n of the display signals, and then the time sequence controller may adjust the starting locations of the gate driving signals in the different lines therein, i.e. adjusting forward the starting location of the gate driving signal at the $m^{th}$ line by (m−1)*t2/(n−1). Then, the effect of the time delays in the display areas caused by the transmission paths may be eliminated.

It is noted that, in above embodiments, the process that the first time sequence controller adjusts the time sequence of the gate driving signal for the time delay caused by the signal transmission path in the corresponding display area also applies to other time sequence controllers. The embodiment of the present invention herein is only illustrative and thus is not limitative of the present invention.

The display device provided in the embodiment of the present invention comprises the display panel driving device as described above. The display device may be a LCD panel, e-paper, OLED panel, mobile phone, tablet computer, television, monitor, laptop, camera, video camera, digital photo frame, navigation equipment or any other products or components with display functions.

It is not described in details for the structure and functions of the display panel driving device since they have been specifically described in the aforesaid embodiments.

The display device provided in the embodiment of the present invention, including the display panel driving device, realizes the synchronization adjustment of the time sequence signals by the time sequence controllers in the partitioning controlled display panel differentially calculating the synchronization signals at different locations and adjusting the starting location of the display image therein, and whereby improves effectively the delay of the gate driving signal. In addition, it is unnecessary to provide a mass of display buffer units for the display panel for this structure, which dramatically reduces the production cost of the display product.

Those skilled in the art will appreciate that all or part of steps of the aforesaid embodiments may be implemented by hardware related to the program instructions, which may be stored in a computer readable storage medium. The program performs the steps of the methods of the aforesaid embodiments. The aforesaid storage medium comprises ROM, RAM, Disc or CD, or various media which may store the program codes.

The above states only the specific embodiments of the present invention, but the scope of the present invention is not limited thereto. Any modifications or alternations which those skilled in the art can easily conceive within the scope disclosed in the present invention shall fall into the protection scope of the present invention. Therefore, the scope of protection of the present invention should be determined by the attaching claims.

What is claimed is:

1. A display panel driving method, wherein the display panel comprises a first display area and a second display area, and a first time sequence controller and a second time sequence controller corresponding to the first display area and the second display area respectively;

the driving method comprises the first time sequence controller obtaining a first frame synchronization signal according to an obtained display signal of the first display area, the first frame synchronization signal comprising a starting time of a first line of scanning signals of the first display area, the second time sequence controller obtaining a second frame synchronization signal according to an obtained display signal of the second display area, the second frame synchronization signal comprising a starting time of a first line of scanning signals of the second display area, the first time sequence controller and the second time sequence controller obtaining a time delay between the starting time of the first line of the scanning signals of the first display area and the starting time of the first line of the scanning signals of the second display area, and the first time sequence controller and the second time sequence controller adjusting the starting times of the first lines of the scanning signals of the respective first and second display areas according to the time delay so as to make the starting times of the first lines of the scanning signals of the first and second display areas are the same;

the first time sequence controller obtaining a third frame synchronization signal according to the display signal of the first display area, the third frame synchronization signal comprising a starting time of the last line of the scanning signals of the first display area;

the first time sequence controller adjusting the starting time of each line of the scanning signals of the first display area by bringing forward starting locations of the gate driving signals on the different lines by (m−1)* second delay time/(n−1) according to the second delay time between the starting time of the first line of the scanning signals and the starting time of the last line of the scanning signals of the first display area so that the starting times of all lines of the adjusted scanning signals of the first display area are the same, wherein m represents a number of line at which the gate driving signal is located, and n represents a vertical resolution of the display signals.

2. The display panel driving method according to claim 1, wherein the first time sequence controller and the second time sequence controller obtaining the time delay between the starting time of the first line of the scanning signals of the first display area and the starting time of the first line of the scanning signals of the second display area comprises:

the first time sequence controller receiving the second synchronization signal sent from the second time sequence controller; and the second time sequence controller receiving the first synchronization signal sent from the first time sequence controller.

3. The display panel driving method according to claim 1, wherein the first time sequence controller and the second time sequence controller adjusting the starting times of the first lines of the scanning signals of the respective first and second display areas according to the time delay comprises: adjusting the starting time of the first line of the scanning signals of the first display area and the starting time of the first line of the scanning signals of the second display area forward or backward by a half of the first time delay, respectively, so as to make the starting time of the first line of the scanning signals of the first display area and the starting time of the first line of the scanning signals of the second display area to be the same.

4. The display panel driving method according to claim 1, wherein the first time sequence controller and the second time sequence controller adjusting the starting times of the first lines of the scanning signals of the respective first and second display areas according to the time delay comprises:

taking the starting time of the first line of the scanning signals of the first display area as a standard time, adjusting the starting time of the first line of the scanning signals of the second display area forward or backward according to the standard time so as to eliminate the time delay of the starting time of the first line of the scanning signals of the second display area compared to the starting time of the first line of the scanning signals of the first display area.

5. The display panel driving method according to claim 1, wherein the first time sequence controller adjusting the starting time of each line of the scanning signals of the first display area comprises:

adjusting the starting time of each line of the scanning signals of the first display area forwardly according to the second time delay.

6. The display panel driving method according to claim 1, wherein the first time sequence controller and the second time sequence controller adjusting the starting times of the first lines of the scanning signals of the respective first and second display areas comprises inserting or removing an invalid data time at vertical direction in the scanning signals.

7. The display panel driving method according to claim 1, wherein the number of registers in at least one of the first and second sequence controllers is increased for eliminating the effect on displaying due to forwarding or delaying the lines of the scanning signals.

8. A display panel driving device, comprising a first time sequence controller and a second time sequence controller, the first time sequence controller corresponding to a first display area, and a second time sequence controller corresponding to the second display area;

wherein the first time sequence controller obtains a first frame synchronization signal according to an obtained display signal of the first display area, the first frame synchronization signal comprises a starting time of a first line of scanning signals of the first display area, the second time sequence controller obtains a second frame synchronization signal according to an obtained display signal of the second display area, the second frame synchronization signal comprises a starting time of a first line of scanning signals of the second display area, the first time sequence controller and the second time sequence controller obtain a time delay between the starting time of the first line of the scanning signals of the first display area and the starting time of the first line of the scanning signals of the second display area, and the first time sequence controller and the second time sequence controller adjust the starting times of the first lines of the scanning signals of the respective first and second display areas according to the time delay so as to make the starting times of the first lines of the scanning signals of the first and second display areas are the same;

wherein the first time sequence controller obtains a third frame synchronization signal according to the display signal of the first display area, the third frame synchronization signal comprises a starting time of the last line of the scanning signals of the first display area;

wherein the first time sequence controller adjusts the starting time of each line of the scanning signals of the first display area by bringing forward starting locations of the gate driving signals on the different lines by (m−1)*second delay time/(n−1), according to the second delay time between the starting time of the first line of the scanning signals and the starting time of the last line of the scanning signals of the first display area so that the starting times of all lines of the adjusted scanning signals of the first display area are the same, wherein m represents a number of line at which the gate driving signal is located, and n represents a vertical resolution of the display signals.

9. The display panel driving device according to claim 8, wherein the first time sequence controller receives the second frame synchronization signal sent by the second time sequence controller, the second time sequence controller receives the first frame synchronization signal sent by the first time sequence controller; and the first and the second time sequence controllers adjusting the starting time of the first line of the scanning signals of the first display area and the starting time of the first line of the scanning signals of the second display area forward or backward by half of the first time delay, respectively, so as to make the starting time of the first line of the scanning signals of the first display area and the starting time of the first line of the scanning signals of the second display area to be the same.

10. The display panel driving device according to claim 8, wherein the starting time of the first line of the scanning signals of the first display area is taken as a standard time, the second time sequence controller adjusts the starting time of the first line of the scanning signals of the second display area forward or backward according to the standard time so as to eliminate the time delay of the starting time of the first line of the scanning signals of the second display area compared to the starting time of the first line of the scanning signals of the first display area.

11. A display device comprising the display panel driving device according to claim 8.

* * * * *